US011542621B1

(12) United States Patent
Haghdoost et al.

(10) Patent No.: US 11,542,621 B1
(45) Date of Patent: Jan. 3, 2023

(54) COATINGS AND COATED SURFACES INCLUDING LOW-SURFACE ENERGY INORGANIC PARTICLES

(71) Applicant: MAXTERIAL, INC., Richmond, CA (US)

(72) Inventors: Atieh Haghdoost, San Pablo, CA (US); Mehdi Kargar, San Pablo, CA (US)

(73) Assignee: Maxterial, Inc., Pleasanton, CA (US)

( * ) Notice: Subject to any disclaimer, the term of this patent is extended or adjusted under 35 U.S.C. 154(b) by 631 days.

(21) Appl. No.: 15/694,155

(22) Filed: Sep. 1, 2017

Related U.S. Application Data

(60) Provisional application No. 62/456,224, filed on Feb. 8, 2017, provisional application No. 62/434,201, filed on Dec. 14, 2016, provisional application No. 62/383,355, filed on Sep. 2, 2016.

(51) Int. Cl.

| | |
|---|---|
| ***C25D 15/00*** | (2006.01) |
| ***C25D 3/12*** | (2006.01) |
| ***B05D 3/02*** | (2006.01) |
| ***B05D 1/02*** | (2006.01) |
| ***C23C 18/16*** | (2006.01) |
| ***C25D 3/02*** | (2006.01) |
| ***C25D 9/04*** | (2006.01) |
| ***C25D 3/00*** | (2006.01) |
| ***C25D 5/22*** | (2006.01) |

(52) U.S. Cl.
CPC ..... *C25D 15/00* (2013.01); *B05D 1/02* (2013.01); *B05D 3/0272* (2013.01); *C23C 18/1662* (2013.01); *C25D 3/00* (2013.01); *C25D 3/02* (2013.01); *C25D 3/12* (2013.01); *C25D 5/22* (2013.01); *C25D 9/04* (2013.01)

(58) Field of Classification Search
None
See application file for complete search history.

(56) References Cited

U.S. PATENT DOCUMENTS

| | | | | |
|---|---|---|---|---|
| 3,756,925 A * | 9/1973 | Takeuchi | ..... | C25D 15/02 205/109 |
| 4,043,878 A * | 8/1977 | Ehrsam | ..... | C25D 15/02 205/109 |
| 4,222,828 A * | 9/1980 | Zuurdeeg | ..... | C25D 15/02 204/490 |

OTHER PUBLICATIONS

Zhao et al (RSC Adv., 2016,6, 59104-59112). (Year: 2016).*

* cited by examiner

*Primary Examiner* — Louis J Rufo
(74) *Attorney, Agent, or Firm* — Christopher Rhodes; Rhodes IP PLC

(57) ABSTRACT

Articles comprising a substrate and a coating are described. In some examples, the coating is disposed on at least one region of the surface and comprises at least one hydrophobic layer. In some instances, the hydrophobic layer comprises a composite comprising a single metallic element or metallic compound and at least one type of surface-modified inorganic particles to provide a metal-based matrix. In certain examples, the at least one type of surface-modified inorganic particles within the metal-based matrix is embedded within the metal-based matrix and is separate from the single metallic element or metallic compound in the metal-based matrix. Processes for producing the coatings and articles are also described.

12 Claims, 9 Drawing Sheets

Our hydrophobic composite coating

Electroless Ni-PTFE

COATINGS AND COATED SURFACES INCLUDING LOW-SURFACE ENERGY INORGANIC PARTICLES

PRIORITY APPLICATIONS

This application is related to, and claims priority to and the benefit of, each of U.S. Provisional Application No. 62/383,355 filed on Sep. 2, 2016, U.S. Provisional Application No. 62/434,201 filed on Dec. 14, 2016 and U.S. Provisional Application No. 62/456,224 filed on Feb. 8, 2017, the entire disclosure of which is hereby incorporated herein by reference for all purposes.

TECHNOLOGICAL FIELD

Certain embodiments described herein relate to coatings which comprise at least one hydrophobic layer. More particularly, certain embodiments relate to coatings which comprise surface modified inorganic particles.

BACKGROUND

Coatings present on a surface are often subjected to various external forces and environmental conditions. These forces and conditions can lead to degradation of the coatings.

SUMMARY

Certain aspects, examples and configurations are directed to coatings comprising a hydrophobic layer which can include, for example, a metal-based matrix comprising a metallic element or metal compound and surface modified inorganic particles. Illustrative coatings are described in more detail below.

In one aspect, an article comprising a surface comprising at least one region and a coating disposed on the at least one region of the surface is described. In some examples, the disposed coating comprises at least one hydrophobic layer. For example, the hydrophobic layer comprises a composite comprising a single metallic element or metallic compound and at least one type of surface-modified inorganic particles to provide a metal-based matrix. In some instances, the at least one type of surface-modified inorganic particles within the metal-based matrix is embedded within the metal-based matrix and is separate from the single metallic element or metallic compound in the metal-based matrix.

In certain embodiments, the disposed coating has or provides an increased durability compared to a coating comprising the metal-based matrix without any embedded surface-modified inorganic particles.

In some examples, the surface-modified inorganic particles are chemically or physically surface modified particles selected from the group consisting of silica ($SiO_2$) particles, platinum oxide ($Pt_2O$), alumina particles ($Al_2O_3$), silicon carbide (SiC), single wall carbon nanotubes (SWCNTs), multi-wall carbon nanotubes (MWCNTs), diatomaceous earth (DE), boron nitride (BN), titanium oxide ($TiO_2$), mixture of titanium/silica oxide ($TiO_2/SiO_2$, titanium inner core/silicon outer surface), ceramic particles, thermo-chromic metal oxides, diamond, particles formed by differential etching of spinodal decomposed glass, molybdenum disulfide ($MoS_2$), boron nitride (BN), sulfides, selenides and tellurides (chalcogenides) of molybdenum, tungsten, niobium, tantalum, and titanium (e.g., $WS_2$, $WSe_2$, $MoSe_2$, $TaSe_2$, $TiTe_2$), monochalcenides (GaS, GaSe, SnSe), chlorides of cadmium, cobalt, lead, cerium, zirconium (eg. $CdCl_2$, $CoCl_2$, $PbCl_2$, $CeF_3$, PbI2), borates (eg. $Na_2B4O_7$) sulfates (eg. $Ag_2SO_4$), and any combination thereof.

In other examples, the surface-modified inorganic particles are inorganic particles functionalized with a low surface energy compound selected from the group consisting of an organofunctional silane, parylene, fluorinated alkylsilane, fluorinated alkylsiloxane, fluorinated based organo-functional silane, fluorinated based organo-functional siloxane, organofunctional resins, hybrid inorganic organo-functional resins, silicone polymers, polydimethylsiloxane, organofunctional silicone polymers, organofunctional silicone copolymers, fluorinated organofunctional silicone copolymers, organo-functional oligomeric siloxane, fluorinated organo-functional oligomeric siloxane, organofunctional polyhedral oligomeric silsesquioxane (POSS), fluorinated polyhedral oligomeric silsesquioxane (FPOSS), fluorinated oligomeric polysiloxane, organofunctional oligomeric poly siloxane, fluorinated organofunctional silicone copolymers, organofunctional silicone polymers, hybrid inorganic organofunctional silicone polymers, organofunctional silicone copolymers, hybrid inorganic organofunctional silicone copolymers, non-volatile linear and branched alkanes, alkenes and alkynes; esters of linear and branched alkanes, alkenes and alkynes, perfluorinated organic material, silane coupling agents, organofunctional silane systems, and any combinations thereof.

In certain configurations, the metallic element is selected from the group consisting of Nickel (Ni), Copper (Cu), Zinc (Zn), Cobalt (Co), Chromium (Cr), Manganese (Mn), Silver (Ag), Gold (Au), Titanium (Ti), Cadmium (Cd), and Platinum (Pt).

In some embodiments, the metallic compound is selected from the group consisting of metal oxides, metal carbides, metal nitrides, metal hydroxides, metal carbonitrides, metal oxynitrides, metal borides, metal borocarbides, and metal fluorides.

In some instances, the surface of the hydrophobic layer comprises at least one additional layer selected from the group consisting of a layer comprising a cross-linkable hybrid inorganic-organic material, an organic coating layer or a combination thereof.

In certain examples, the additional layer comprises at least one compound selected from the group consisting of surface-modified inorganic particles, organofunctional silane, parylene, fluorinated alkylsilane, fluorinated alkylsiloxane, fluorinated based organo-functional silane, fluorinated based organo-functional siloxane, organofunctional resins, hybrid inorganic organofunctional resins, silicone polymers, polydimethylsiloxane, organofunctional silicone polymers, organofunctional silicone copolymers, fluorinated organo-functional silicone copolymers, organo-functional oligomeric siloxane, fluorinated organo-functional oligomeric siloxane, organofunctional polyhedral oligomeric silsesquioxane (POSS), fluorinated polyhedral oligomeric silsesquioxane (FPOSS), fluorinated oligomeric polysiloxane, organofunctional oligomeric poly siloxane, fluorinated organofunctional silicone copolymers, organofunctional silicone polymers, hybrid inorganic organofunctional silicone polymers, organofunctional silicone copolymers, hybrid inorganic organofunctional silicone copolymers, non-volatile linear and branched alkanes, alkenes and alkynes; esters of linear and branched alkanes, alkenes and alkynes, perfluorinated organic material, silane coupling agents, organofunctional silane systems, polymer blends and combinations thereof.

In some configurations, the coating provides anti-fingerprint, hygienic, easy-clean, self-cleaning, anti-corrosion, anti-icing, water repellency, oleophobicity, or anti-bioadhesion properties.

In certain examples, a contact angle of water on at least 20%-50% of the hydrophobic layer is more than 90 degrees.

In other examples, water contact angle of the coating changes less than 20 percent after a thermal process at 100 degrees Celsius or higher for 12 hours or longer.

In some embodiments, in a cleanability test, where the food is placed on the surface and after heating the surface up, at least 50 percent of the food residue on the surface can get be removed by a wipe.

In another aspect, a process for producing a coating on a substrate, wherein the process comprises at least one electrochemical deposition technique is disclosed. In some examples, the process comprises forming an aqueous solution comprising one positively-charged metal-based agent and at least one type of surface-modified inorganic particles dispersed in the solution. The process may also comprise positioning a substrate in the solution. The process may also comprise electrochemically depositing a hydrophobic layer comprising a single metallic element or metallic compound and at least one type of surface-modified inorganic particles embedded within the metal-based matrix and separated from the metal-based matrix using the formed aqueous solution.

In certain examples, the hydrophobic layer is producing using a combination of an electrochemical deposition technique and at least one other technique selected from the group consisting of annealing, thermal processing, vacuum conditioning, aging, plasma etching, grit blasting, wet etching, ion milling, exposure to electromagnetic radiation, and combinations thereof.

In other examples, the electrochemical deposition technique is selected from the group consisting of electrodeposition process, electroplating, electroless deposition process, auto-catalytic plating, plating, and combinations thereof.

In some instances, the surface-modified inorganic particles are dispersed in the aqueous solution using at least one organic solvent selected from the group consisting of ethanol, methanol, propanol, isopropanol, dichloromethane, acetone, hexane, toluene, tetrahydrofuran, and combinations thereof.

In other instances, the surface-modified inorganic particles are dispersed in the aqueous solution using at least one surfactant selected from the group consisting of cationic, anionic, zwitterionic, nonionic, polymeric cationic agents, and combinations thereof.

In some examples, the surface-modified inorganic particles are dispersed in the aqueous solution using at least one organic solvent and at least one surfactant.

In certain examples, the aqueous solution comprises at least one cationic surfactant selected from the group consisting of alkylated and heavily alkylated quaternary ammonium salts, perfluorinated organo functional quaternary ammonium salts, Cetrimonium bromide or CTAB (cetyltrimethyl ammonium bromide), Cetylpyridinium chloride, Lauryl methyl gluceth-10 hydroxypropyl dimonium chloride, Domiphen bromide, Benzododecinium bromide, Octenidine dihydrochloride, fluoro-surfactant products, and combinations thereof.

In some embodiments, the aqueous solution comprises at least one negatively-charged agent selected from the group consisting of bromide (Br), carbonate ($CO_3^-$), hydrogen carbonate ($HCO_3^-$), chlorate ($ClO_3^-$), chromate ($CrO_4^-$), cyanide ($CN^-$), dichromate ($Cr_2O_7^{2-}$) dihydrogenphosphate ($H_2PO_4^-$), fluoride ($F^-$), hydride ($H^-$), hydrogen phosphate ($HPO_4^{2-}$) hydrogen sulfate or bisulfate ($HSO_4^-$), hydroxide ($OH^-$), iodide ($F^-$), nitride ($N^{3-}$), nitrate ($NO_3^-$), nitrite ($NO_2^-$), oxide ($O_2^-$), permanganate ($MnO_4^-$), peroxide ($O_2^{2-}$), phosphate ($PO_4^{3-}$), sulfide ($S^{2-}$), thiocyanate ($SCN^-$), sulfite ($SO_3^{2-}$), sulfate ($SO_4^{2-}$), chloride ($Cl^-$), boride ($B^{3-}$), borate ($BO_3^{3-}$), disulfide ($S_2^{2-}$), phosphanide ($PH_2^-$), phosphanediide ($PH^{2-}$), superoxide ($O_2^-$), ozonide ($O_3^-$), triiodide ($I_3^-$), dichloride ($Cl_2^-$), dicarbide ($C_2^{2-}$), azide ($N_3^-$), pentastannide ($Sn_5^{2-}$), nonaplumbide ($Pb_9^{4-}$), azanide or dihydridonitrate ($NH_2^-$), germanide ($GeH_3^-$), sulfanide ($HS^-$), sulfanuide ($H_2S^-$), hypochlorite ($ClO^-$), hexafluoridophosphate ($[PF_6]^-$), tetrachloridocuprate(II) ($[CuCl_4]^{2-}$) tetracarbonylferrate ($[Fe(CO)_4]^{2-}$), tetrafluoroborate ($[BF_4^-]$), Bis(trifluoromethylsulfonyl)imide ($[NTf_2]^-$), trifluoromethanesulfonate ($[TfO]^-$), Dicyanamide $[N(CN)_2]^-$, methylsulfate $[MeSO_4]^-$, dimethylphosphate $[Me_2PO_4]^-$, acetate $[MeCO_2]^-$, and combinations thereof.

In certain examples, the aqueous solution comprises at least one nickel salt, and the total concentration of nickel ion in the aqueous solution is between 50 g/L to 1000 g/L.

In some embodiments, the nickel salt is Nickel Sulfate ($NiSO_4$) or Nickel chloride ($NiCl_2$) or both.

In certain examples, the electrochemical deposition technique is electroless plating in which the positively-charged metal-based agent is reduced to metal-based component using a reducing agent selected from the group consisting of sodium hypophosphate, sodium borohydride, dimethylamineborane, hydrazine, formaldehyde, and combinations thereof.

In other examples, the mixture comprises a pH adjusting agent selected from the group consisting of weak acids, ammonium bases, phosphonium bases, and combinations thereof in an amount between 5 g/L to 500 g/L.

In some instances, the process comprises performing the electrochemical deposition technique under non-agitating or an agitating condition with an agitation rate from 0 to 800 rpm.

In other instances, the process comprises applying a constant or varying voltage in a range of −0.1 to −100 V or applying a constant or varying current density in a range of −5 to −500 mA/cm$^2$ to reduce the positively-charged metal-based agent.

In some examples, the solution comprises at least one additive selected from the group consisting of thiourea, acetone, ethanol, cadmium ion, chloride ion, stearic acid, ethylenediamine dihydrochloride, saccharin, cetyltrimethylammonium bromide (CTAB), sodium dodecyl sulfate, ethyl vanillin, ammonia, ethylene diamine, polyethylene glycol (PEG), bis(3-sulfopropyl)disulfide (SPS), Janus green B (JGB), azobenzene-based surfactant (AZTAB), the polyoxyethylene family of surface active agents, sodium citrate, perfluorinated alkylsulfate, additive K, calcium chloride, ammonium chloride, potassium chloride, boric acid, myristic acid, choline chloride, citric acid, any redox active surfactant, any conductive ionic liquids, any wetting agents, any leveling agent, any defoaming agent, any emulsifying agent or any combination thereof.

In other examples, the wetting agent comprises one or more of polyglycol ethers, polyglycol alcohols, sulfonated oleic acid derivatives, sulfate form of primary alcohols, alkylsulfonates, alkylsulfates, aralkylsulfonates, sulfates, Perfluoro-alkylsulfonates, acid alkyland aralkyl-phosphoric acid esters, alkylpolyglycol ether, alkylpolyglycol phosphoric acid esters or their salts, or any combination thereof.

In some embodiments, the leveling agent comprises one or more of N-containing and optionally substituted and/or quaternized polymers, such as polyethylene imine and its derivatives, polyglycine, poly(allylamine), polyaniline (sulfonated), polyvinylpyrrolidone, polyvinylpyridine, polyvinylimidazole, polyurea, polyacrylamide, poly(melamine-co-formaldehyde), polyalkanolamines, polyaminoamide and derivatives thereof, polyalkanolamine and derivatives thereof, polyethylene imine and derivatives thereof, quaternized polyethylene imine, poly(allylamine), polyaniline, polyurea, polyacrylamide, poly(melamine-co-formaldehyde), reaction products of amines with epichlorohydrin, reaction products of an amine, epichlorohydrin, and polyalkylene oxide, reaction products of an amine with a polyepoxide, polyvinylpyridine, polyvinylimidazole, polyvinylpyrrolidone, or copolymers thereof, nigrosines, pentamethyl-para-rosaniline, or any combination thereof in the amount of 1 g/L to 40 g/L.

In other embodiments, the defoaming agent comprises one or more of fats, oils, long chained alcohols, or glycols, alkylphosphates, metal soaps, special silicone defoamers, commercial perfluoroalkyl-modified hydrocarbon defoamers and perfluoroalkyl-substituted silicones, fully fluorinated alkylphosphonates, perfluoroalkyl-substituted phosphoric acid esters, or any combination thereof.

In some instances, the emulsifying agent comprises one or more of cationic-based agents, amphoteric-based agents, and nonionic-based agent.

In other examples, the process comprises using at least one additional coating process selected from the group consisting of electrodeposition, electroless deposition, surface functionalization, electro-polymerization, spray coating, brush coating, dip coating, electrophoretic deposition, reaction with fluorine gas, plasma deposition, brush plating, chemical vapor deposition, sputtering, physical vapor deposition, passivation through the reaction of fluorine gas, any other coating technique, and any combination thereof after or before using the electrodeposition technique.

Additional aspects, configurations, embodiments and examples are described in more detail below.

BRIEF DESCRIPTION OF THE SEVERAL VIEWS OF THE DRAWINGS

Certain configurations are described with reference to the accompanying figures in which.

DETAILED DESCRIPTION

In certain embodiments, a substrate that comprises a surface that includes a coating with one or more the selected attributes including surface features, composition, and hydrophobic characteristics of the surface coating.

In some instances, a surface comprises at least one region, and a coating disposed on the region of the surface. For example the coating comprises at least one hydrophobic layer, wherein the hydrophobic layer can be a composite comprising a metal-based matrix and at least one type of surface-modified inorganic particles within the matrix and separated from the matrix.

Figure 1:
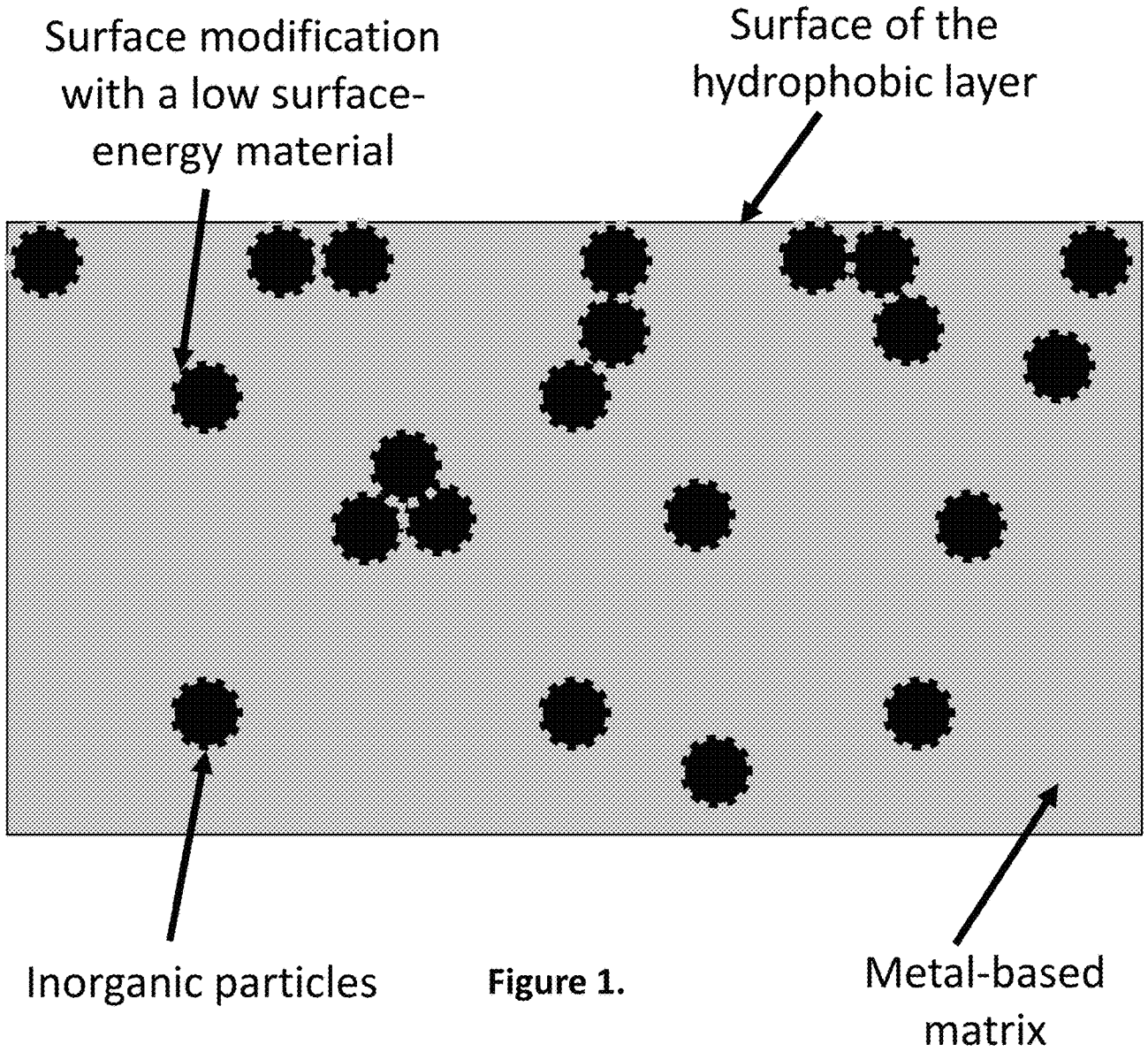
FIG. 1 is an illustration showing a hydrophobic coating layer.

FIG. 1 shows the schematic of the hydrophobic coating layer. The hydrophobic layer can be configured as a two-phase material comprising a metal-based matrix and a separate phase of inorganic particles. While not wishing to be bound by any particular theory, the inorganic particles may aggregate and occupy more volume of the second phase in some locations of the hydrophobic layer. As used herein, a hydrophobic layer refers to a layer that exhibits a water contact angle of more than 90 degree on at least 20 to 50 percent of its surface. It is worth mentioning that hydrophobicity is the result, at least in part, of the surface-modified inorganic particles that are exposed on the surface of the coating layer. These particles can be modified with at least one low surface-energy material. As used herein, low surface energy materials refer to materials with a lower surface energy than water. Surface energy of water is 72 $mJ/m^2$. The low surface energy particles that are embedded in the bulk of the coating layer, e.g., not on the surface, do not contribute to the hydrophobicity to a substantial degree. However, these particles can enhance the durability of the hydrophobic property in the coating layer. For example, if a portion of the coating layer is abraded or otherwise removed and particles in that portion are removed, additional particles within the coating layer can become exposed on the surface and contribute to the hydrophobicity of the layer. Therefore, in some configurations hydrophobicity is not reduced to a substantial degree by mechanical abrasion.

As used herein, the term "metal-based matrix" refers to a matrix which comprises a single metallic element or metallic compound comprising a single metallic element. The metal-based matrix does not include any alloys or combinations of two or more metals or metallic compounds. Examples of metallic elements include but not limited to Nickel (Ni), Copper (Cu), Zinc (Zn), Cobalt (Co), Chromium (Cr), Manganese (Mn), Silver (Ag), Gold (Au), Titanium (Ti), Cadmium (Cd), and Platinum (Pt). Examples of metallic compounds include but not limited to metal oxides, metal carbides, metal nitrides, metal hydroxides, metal carbonitrides, metal oxynitrides, metal borides, metal borocarbides, metal fluorides, other metal compounds.

In certain examples, the inorganic particles can be non-porous or porous and include, for example, a plurality of nanopores. Moreover, some of the nanopores can provide flow through porosity. The inorganic particles can have particle sizes ranging from at least 100 nm to about 10 microns. The individual particles can have a pore size ranging from 10 nm to about 10 microns, or 100 nm to 8 microns, or 500 nm to 6 microns, or 1 to 5 microns, or any combination thereof. However, the aggregate of the particles can be as big as tens of micrometers. Examples of inorganic particles include but not limited to silica ($SiO_2$) particles, platinum oxide ($Pt_2O$), alumina particles ($Al_2O_3$), silicon carbide (SiC), single wall carbon nanotubes (SWCNTs), multi-wall carbon nanotubes (MWCNTs), diatomaceous earth (DE), boron nitride (BN), titanium oxide ($TiO_2$), mixture of titanium/silica oxide ($TiO_2/SiO_2$, titanium inner core/silicon outer surface), ceramic particles, thermo-chromic metal oxide, diamond, particles formed by differential etching of spinodal decomposed glass, molybdenum disulfide ($MoS_2$), boron nitride (BN), sulfides, selenides and tellurides (chalcogenides) of molybdenum, tungsten, niobium, tantalum, and titanium (eg. $WS_2$, $WSe_2$, $MoSe_2$, $TaSe_2$, $TiTe_2$), monochalcenides (GaS, GaSe, SnSe), chlorides of cadmium, cobalt, lead, cerium, zirconium (eg. $CdCl_2$, $CoCl_2$, $PbCl_2$, $CeF_3$, PbI2), borates (eg. $Na_2B4O_7$) sulfates (eg. $Ag_2SO_4$), any chemically or physically modified versions of the foregoing particles, and any combination thereof.

As noted above, the surface of the inorganic particles can be modified with at least one low surface-energy material. Therefore, the modified particles may be referred to in certain instances herein as low surface-energy inorganic particles. Examples of low surface-energy materials that can be used for surface modification of inorganic particles include, but are not limited to, organofunctional silane, parylene, fluorinated alkylsilane, fluorinated alkylsiloxane, fluorinated based organo-functional silane, fluorinated based organo-functional siloxane, organofunctional resins, hybrid inorganic organofunctional resins, silicone polymers, polydimethylsiloxane, organofunctional silicone polymers, organofunctional silicone copolymers, fluorinated organo-functional silicone copolymers, organo-functional oligomeric siloxane, fluorinated organo-functional oligomeric siloxane, organofunctional polyhedral oligomeric silsesquioxane (POSS), fluorinated polyhedral oligomeric silsesquioxane (FPOSS), fluorinated oligomeric polysiloxane, organofunctional oligomeric poly siloxane, fluorinated organofunctional silicone copolymers, organofunctional silicone polymers, hybrid inorganic organofunctional silicone polymers, organofunctional silicone copolymers, hybrid inorganic organofunctional silicone copolymers, non-volatile linear and branched alkanes, alkenes and alkynes; esters of linear and branched alkanes, alkenes and alkynes, perfluorinated organic material, silane coupling agents, organofunctional silane systems, or any combinations thereof.

Figure 2:
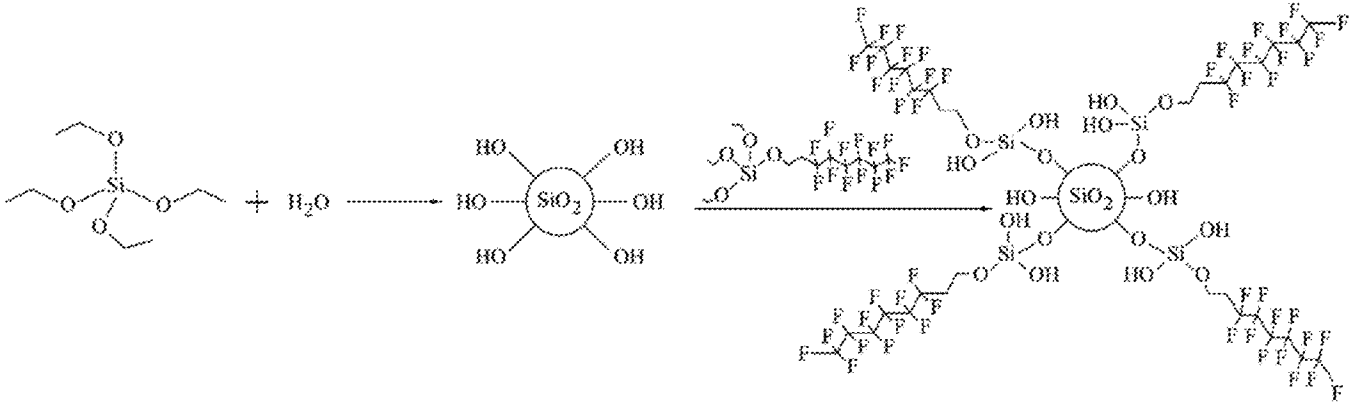
FIG. 2 is an illustration showing how a low surface energy inorganic particle can be produced.

A non-prophetic example of low surface-energy materials that can be used for surface modification of inorganic particles comprises a group of organofunctional silanes. Organofunctional silanes are a group of compounds that combine the functionality of an organic group and an inorganic group in a single molecule. They have a functional group that can act as a molecular bridge between organic and inorganic compounds. FIG. 2 shows an illustration of how an organofunctional silane can chemically react with silica particles and modify the surface of silica particles.

The organic moiety of the silane system can be tailored with different functionalities consisting amino, benzylamino, benzyl, chloro, disulfido, epoxy, epoxy/melamine, mercapto, methacrylate, tetrasulfido, fluorinated alkyl/aryl, ureido, vinyl, vinyl-benzyl-amino, and any combination thereof. The examples of aminosilane system are n-(3-acryloxy-2-hydroxypropyl)-3-aminopropyltriethoxysilane, n-(n-acetylleucyl)-3-aminopropyltriethoxysilane, 3-(n-allylamino)propyltrimethoxysilane, 4-aminobutyltriethoxysilane, 4-amino-3,3-dimethylbutylmethyldimethoxysilane, 4-amino-3,3-dimethylbutyltrimethoxysilane, aminoneohexyltrimethoxysilane, 1-amino-2-(dimethylethoxysilyl)propane, n-(2-aminoethyl)-3-aminoisobutyldimethylmethoxysilane, n-(2-aminoethyl)-3-aminoisobutylmethyldimethoxysilane, (aminoethylaminomethyl)phenethyltrimethoxysilane, n-(2-aminoethyl)-3-aminopropylmethyldiethoxysilane, n-(2-aminoethyl)-3-aminopropylmethyldimethoxysilane, n-(2-aminoethyl)-3-aminopropyltrimethoxysilane-propyltrimethoxysilane, oligomeric co-hydrolysate, n-(2-aminoethyl)-2,2,4-trimethyl-1-aza-2-silacyclopentane, n-(6-aminohexyl)aminomethyltriethoxysilane, n-(2-aminoethyl)-11-aminoundecyltrimethoxysilane, 3-(m-aminophenoxy)propyltrimethoxysilane, m-aminophenyltrimethoxysilane, p-aminophenyltrimethoxysilane, aminophenyltrimethoxysilane, n-3-[(amino(polypropylenoxy)]aminopropyltrimethoxysilane, 3-aminopropyldiisopropylethoxysilane, 3-aminopropyldiisopropylethoxysilane, 3-aminopropyldimethylethoxysilane, 3-aminopropyldimethylfluorosila, n-(3-aminopropyldimethylsilyl)aza-2,2-dimethyl-2-silacyclopentane, 3-aminopropylmethyldiethoxysilane, 3-aminopropyltris(methoxyethoxyethoxy)silane, 11-aminoundecyltriethoxysilane, n-(2-n-benzylaminoethyl)-3-aminopropyltrimethoxysilane, n,n-bis(2-hydroxyethyl)-3-aminopropyltriethoxysilane, bis(trimethylsilyl)-3-aminopropyltrimethoxysilane, n-butylaminopropyltrimethoxysilane, t-butylaminopropyltrimethoxysilane, (n-cyclohexylaminomethyl) methyldiethoxysilane, (n-cyclohexylaminopropyl) trimethoxysilane, (n,n-diethylaminomethyl)triethoxysilane, (n,n-diethyl-3-aminopropyl)trimethoxysilane, 3-(n,n-dimethylaminopropyl)aminopropylmethyldimethoxysilane, (n,n-dimethylaminopropyl)-aza-2-methyl-2-methoxysilacyclopentane, n,n-dimethyl-3-aminopropylmethyldimethoxysilane, 3-(1,3-dimethylbutylidene)aminopropyltriethoxysilane, (3-(n-ethylamino)isobutyl)methyldiethoxysilane, (3-(n-ethylamino)isobutyl)trimethoxysilane, n-methyl-n-trimethylsilyl-3-aminopropyltrimethoxysilane, (phenylaminomethyl)methyldimethoxysilane, n-phenylaminomethyltriethoxysilane, n-phenylaminopropyltrimethoxysilane, 3-(n-styrylmethyl-2-aminoethylamino)propyltrimethoxysilane hydrochloride, (3-trimethoxysilylpropyl) diethylenetriamine, (cyclohexylaminomethyl)triethoxysilane, (n-methylaminopropyl)methyl(1,2-propanediolato) silane, n-(trimethoxysilylpropyl)ethylenediaminetriacetate, tripotassium salt, n-(trimethoxysilylpropyl)ethylenediaminetriacetate, trisodium salt, 1-[3-(2-aminoethyl)-3-aminoisobutyl]-1,1,3,3,3-pentaethoxy-1,3-disilapropane, bis(methyldiethoxysilylpropyl)amine, bis (methyldimethoxysilylpropyl)-n-methylamine, bis(3-triethoxysilylpropyl)amine, n,n'-bis[(3-trimethoxysilyl) propyl]ethylenediamine, tris(triethoxysilylpropyl)amine, tris(triethoxysilylmethyl)amine, bis[4-(triethoxysilyl)butyl] amine, tris[(3-diethoxymethylsilyl)propyl)amine, n-(hydroxyethyl)-n,n-bis(trimethoxysilylpropyl)amine, n-(hydroxyethyl)-n-methylaminopropyltrimethoxysilane, n-(3-methacryloxy-2-hydroxypropyl)-3-aminopropyltriethoxysilane, 3-(n-styrylmethyl-2-aminoethylamino)propyltrimethoxysilane, 3-(2,4-dinitrophenylamino)propyltriethoxysilane, 4-nitro-4(n-ethyl-n-trimethoxysilylcarbamato)aminoazobenzene, bis (diethylamino)dimethylsilane, bis(dimethylamino) diethylsilane, bis(dimethylamino)dimethylsilane, (diethylamino)trimethylsilane, (n,n-dimethylamino)trimethylsilane, tris(dimethylamino)methylsilane, n-butyldimethyl (dimethylamino)silane, n-decyltris(dimethylamino)silane, n-octadecyldiisobutyl(dimethylamino)silane, n-octadecyldimethyl(diethylamino)silane, n-octadecyldimethyl(dimethylamino)silane, n-octadecyltris(dimethylamino)silane, n-octyldiisopropyl(dimethylamino)silane, n-octyldimethyl (dimethylamino)silane, and any combination thereof. the examples of the benzylaminosilane system are n-(2-n-benzylaminoethyl)-3-aminopropyltrimethoxysilane, n-(2-n-benzylaminoethyl)-3-aminopropyltrimethoxysilane hydrochloride, n-benzylaminomethyltrimethylsilane, or any combination thereof. The example of benzylsilane system are benzyldimethylchlorosilane, benzyldimethylsilane, n-benzyl-n-methoxymethyl-n-(trimethylsilylmethyl) amine, benzyloxytrimethylsilane, benzyltrichlorosilane, benzyltriethoxysilane, benzyltrimethylsilane, bis(trimethylsilylmethyl)benzylamine, (4-bromobenzyl) trimethylsilane, dibenzyloxydiacetoxysilane, or any combination thereof. The examples of chloro and chlorosilane system are (−)-camphanyldimethylchlorosilane, 10-(carbomethoxy)decyldimethylchlorosilane, 10-(carbomethoxy)decyltrichlorosilane, 2-(carbomethoxy)ethylmethyldichlorosilane, 2-(carbomethoxy)ethyltrichlorosilane, 3-chloro-n,n-bis(trimethylsilyl)aniline, 4-chlorobutyldimethylchlorosilane, (chlorodimethylsilyl)-5-[2-(chlorodimethylsilyl)ethyl] bicycloheptane, 13-(chlorodimethylsilylmethyl) heptacosane, 11-(chlorodimethylsilyl)methyltricosane, 7-[3-(chlorodimethylsilyl)propoxy]-4-methylcoumarin, 2-chloroethylmethyldichlorosilane, 2-chloroethylmethyldimethoxysilane, 2-chloroethylsilane, 1-chloroethyltrichlorosilane, 2-chloroethyltrichlorosilane, 2-chloroethyltriethoxysilane, 1-chloroethyltrimethylsilane, 3-chloroisobutyldimethylchlorosilane, 3-chloroisobutyldimethylmethoxysilane, 3-chloroisobutylmethyldichlorosilane, 1-(3-chloroisobutyl)-1,1,3,3,3-pentachloro-1,3-disilapropane, 1-(3-chloroisobutyl)-1,1,3,3,3-pentaethoxy-1,3-disilapropane, 3-chloroisobutyltrimethoxysilane, 2-(chloromethyl)allyltrichlorosilane, 2-(chloromethyl) allyltrimethoxysilane, 3-[2-(4-chloromethylbenzyloxy) ethoxy]propyltrichlorosilane, chloromethyldimethylchlorosilane, chloromethyldimethylethoxysilane, chloromethyldimethylisopropoxysilane, chloromethyldimethylmethoxysilane, (chloromethyl)dimethylphenylsilane, chloromethyldimethylsilane, 3-(chloromethyl)heptamethyltrisiloxane, chloromethylmethyldichlorosilane, chloromethylmethyldiethoxysilane, chloromethylmethyldiisopropoxysilane, chloromethylmethyldimethoxysilane, chloromethylpentamethyldisiloxane, ((chloromethyl)phenylethyl)dimethylchlorosilane, ((chloromethyl)phenylethyl)methyldichlorosilane, ((chloromethyl)phenylethyl)methyldimethoxysilane, ((chloromethyl) phenylethyl)trichlorosilane, ((chloromethyl)phenylethyl) triethoxysilane, ((chloromethyl)phenylethyl) trimethoxysilane, chloromethylphenethyltris (trimethylsiloxy)silane, (p-chloromethyl) phenyltrichlorosilane, (p-chloromethyl) phenyltrimethoxysilane, chloromethylsilatrane, chloromethyltrichlorosilane, chloromethyltriethoxysilane, chloromethyltriisopropoxysilane, chloromethyltrimethoxysilane, chloromethyltrimethylsilane, 2-chloromethyl-3-trimethylsilyll-propene, chloromethyltris(trimethylsiloxy) silane, (5-chloro-1-pentynyl)trimethylsilane, chlorophenylmethyldichloro-silane, chlorophenyltrichlorosilane, chlorophenyltriethoxysilane, p-chlorophenyltriethoxysilane, p-chlorophenyltrimethylsilane, (3-chloropropoxy)isopropyldimethylsilane, (3-chloropropyl)(t-butoxy)dimethoxysilane, 3-chloropropyldimethylchlorosilane, 3-chloropropyldimethylethoxysilane, 3-chloropropyldimethylmethoxysilane, 3-chloropropyldimethylsilane, 3-chloropropyldiphenylmethylsilane, chloropropylmethyldichlorosilane, 3-chloropropylmethyldiethoxysilane, 3-chloropropylmethyldiisopropoxysilane, 3-chloropropylmethyldimethoxysilane, (3-chloropropyl)pentamethyldisiloxane, 3-chloropropyltrichlorosilane, 3-chloropropyltriethoxysilane, 3-chloropropyltrimethoxysilane, 3-chloropropyltrimethylsilane, 3-chloropropyltriphenoxysilane, 3-chloropropyltris (trimethylsiloxy)silane, 2-(4-chlorosulfonylphenyl) ethyltrichlorosilane, 2-(4-chlorosulfonylphenyl) ethyltrichlorosilane, 2-(4-chlorosulfonylphenyl) ethyltrimethoxysilane, 2-(4-chlorosulfonylphenyl) ethyltrimethoxysilane, 1-chloro-5-(trimethylsilyl)-4-pentyne, chlorotris(trimethylsilyl)silane, 11-chloroundecyltrichlorosilane, 11-chloroundecyltriethoxysilane, 11-chloroundecyltrimethoxysilane, 1-chlorovinyltrimethylsilane, (3-cyanobutyl)dimethylchlorosilane, (3-cyanobutyl)methyldichlorosilane, (3-cyanobutyl) trichlorosilane, 12-cyanododec-10-enyltrichlorosilane, 2-cyanoethylmethyldichlorosilane, 2-cyanoethyltrichlorosilane, 3-cyanopropyldiisopropylchlorosilane, 3-cyanopropyldimethylchlorosilane, 3-cyanopropylmethyldichlorosilane, 3-cyanopropylphenyldichlorosilane, 3-cyanopropyltrichlorosilane, 3-cyanopropyltriethoxysilane, 11-cyanoundecyltrichlorosilane, [2-(3-cyclohexenyl)ethyl]dimethylchlorosilane, [2-(3-cyclohexenyl)ethyl]methyldichlorosilane, [2-(3-cyclohexenyl)ethyl]trichlorosilane, 3-cyclohexenyltrichlorosilane, cyclohexyldimethylchlorosilane, cyclohexylmethyldichlorosilane, (cyclohexylmethyl) trichlorosilane, cyclohexyltrichlorosilane, (4-cyclooctenyl) trichlorosilane, cyclooctyltrichlorosilane, cyclopentamethylenedichlorosilane, cyclopentyltrichlorosilane, cyclotetramethylenedichlorosilane, cyclotrimethylenedichlorosilane, cyclotrimethylenemethylchlorosilane, 1,3-dichlorotetramethyldisiloxane, 1,3-dichlorotetraphenyldisiloxane, dicyclohexyldichlorosilane, dicyclopentyldichlorosilane, di-n-dodecyldichlorosilane, dodecylmethylsilyl)methyldichlorosilane, diethoxydichlorosilane, or any combination thereof. the examples of the epoxysilane system are 2-(3,4-epoxycyclohexyl) ethylmethyldiethoxysilane, 2-(3,4-epoxycyclohexyl) ethyltriethoxysilane, 2-(3,4-epoxycyclohexyl) ethyltrimethoxysilane, 5,6-epoxyhexyltriethoxysilane, (epoxypropyl)heptaisobutyl-T8-silsesquioxane, or any combination thereof. The example of mercaptosilane system are (mercaptomethyl)methyldiethoxysilan, 3-mercaptopropylmethyldimethoxysilane, 3-mercaptopropyltriethoxysilane, 3-mercaptopropyltrimethoxysilane, 3-mercaptopropyltrimethoxysilane, 3-mercaptopropyltrimethylsilane, 3-mercaptopropyltriphenoxysilane, 11-mercaptoundecyloxytrimethylsilane, 11-mercaptoundecyltrimethoxysilane, or any combination thereof. The examples of ureidosilane are ureidopropyltriethoxysilane, ureidopropyltrimethoxysilane, or any combination thereof. The examples of vinyl, vinylbenzylsilane system are vinyl(bromomethyl)dimethylsilane, (m,p-vinylbenzyloxy)trimethylsilane, vinyl-t-butyldimethylsilane, vinyl(chloromethyl)dimethoxysilane, vinyl(chloromethyl)dimethylsilane, 1-vinyl-3-(chloromethyl)-1,1,3,3-tetramethyldisiloxane, vinyldiethylmethylsilane, vinyldimethylchlorosilane, vinyldimethylethoxysilane, vinyldimethylfluorosilane, vinyldimethylsilane, vinyldi-n-octylmethylsilane, vinyldiphenylchlorosilane, vinyldiphenylethoxysilane, vinyldiphenylmethylsilane, vinyl(diphenylphosphinoethyl)dimethylsilane, vinyl(p-methoxyphenyl)dimethylsilane, vinylmethylbis(methylethylketoximino)silane, vinylmethylbis(methylisobutylketoximino)silane, vinylmethylbis(trimethylsiloxy)silane, vinylmethyldiacetoxysilane, vinylmethyldichlorosilane, vinylmethyldichlorosilane, vinylmethyldiethoxysilane, vinylmethyldimethoxysilane, 1-vinyl-1-methylsilacyclopentane, vinyloctyldichlorosilane, o-(vinyloxybutyl)-n-triethoxysilylpropyl carbamate, vinyloxytrimethylsilane, vinylpentamethyldisiloxane, vinylphenyldichlorosilane, vinylphenyldiethoxysilane, vinylphenyldimethylsilane, vinylphenylmethylchlorosilane, vinylphenylmethylmethoxysilane, vinylphenylmethylsilane, vinylsilatrane, vinyl-1,1,3,3-tetramethyldisiloxane, vinyltriacetoxysilane, vinyltri-t-butoxysilane, vinyltriethoxysilane, vinyltriethoxysilane, oligomeric hydrolysate, vinyltriethoxysilane-propyltriethoxysilane, oligomeric co-hydrolysate, vinyltriethylsilane, vinyl(trifluoromethyl)dimethylsilane, vinyl(3,3,3-trifluoropropyl)dimethylsilane, vinyltriisopropenoxysilane, vinyltriisopropoxysilane, vinyltrimethoxysilane, vinyltrimethoxysilane, oligomeric hydrolysate, vinyltrimethylsilane, vinyltriphenoxysilane, vinyltriphenylsilane, vinyltris(dimethylsiloxy)silane, vinyltris(2-methoxyethoxy)silane, vinyltris(1-methoxy-2-propoxy)silane, vinyltris(methylethylketoximino)silane, vinyltris(trimethylsiloxy)silane, or any combination thereof.

The examples of fluorinated alkyl/aryl silane are 4-fluorobenzyltrimethylsilane, (9-fluorenyl) methyldichlorosilane, (9-fluorenyl) trichlorosilane, 4-fluorophenyltrimethylsilane, 1,3-bis(tridecafluoro-1,1,2,2-tetrahydrooctyl) tetramethyldisiloxane, 1H,1H,2H,2H-perfluorodecyltrimethoxysilane, 1H,1H,2H,2H-perfluorodecyltrichlorosilane, 1H,1H,2H,2H-perfluorooctyltrichlorosilane, 1H,1H,2H,2H-perfluorooctadecyltrichlorosilane, 1H,1H,2H,2H-Perfluorooctyltriethoxysilane, 1H,1H,2H,2H-Perfluorododecyltrichlorosilane, Trimethoxy(3,3,3-trifluoropropyl)silane, tridecafluoro-1,1,2,2-tetrahydrooctyl-1-trimethoxysilane, tridecafluoro-1,1,2,2-tetrahydrooctyl-1-triethoxysilane, and any combination thereof.

Organofunctional polyhedral oligomeric silsesquioxane (POSS) can get selected from a group consisting acrylates, alcohols, amines, carboxylic acids, epoxides, fluoroalkyls, halides, imides, methacrylates, molecular silicas, norbornenyls, olefins, polyethylenglycols (PEGs), silanes, silanols, thiols, or any combination thereof. Th example of acrylates POSS is Acrylolsobutyl POSS, or any combination thereof. In the case of Alcohols POSS are Diollsobutyl POSS, Cyclohexanediollsobutyl POSS, Propanediollsobutyl POSS, Octa(3-hydroxy-3-methylbutyldimethylsiloxy) POSS, or any combination thereof. In the case of Amines POSS are Aminopropyllsobutyl POSS, Aminopropyllsooctyl POSS, Aminoethylaminopropyllsobutyl POSS, OctaAmmonium POSS, Aminophenyllsobutyl POSS, Phenylaminopropyl POSS Cage Mixture, or any combination thereof. In the case of Carboxylic Acids POSS are Maleamic Acid-Isobutyl POSS, OctaMaleamic Acid POSS, or any combination thereof. In the case of Epoxides are Epoxycyclohexyllsobutyl POSS, Epoxycyclohexyl POSS Cage Mixture, Glycidyl POSS Cage Mixture, Glycidyllsobutyl POSS, Triglycidyllsobutyl POSS, Epoxycyclohexyl dimethylsilyl POSS, OctaGlycidyldimethylsilyl POSS, or any combination thereof. In the case of fluoroalkyl POSS are Trifluoropropyl POSS Cage Mixture, Trifluoropropyllsobutyl POSS, or any combination thereof. In the case of halid POSS is Chloropropyllsobutyl POSS, or any combination thereof. In the case of Imides POSS is POSS Maleimide Isobutyl, or any combination thereof. In the case of Methacrylates is Methacrylolsobutyl POSS, Methacrylate Ethyl POSS, Methacrylate Isooctyl POSS, Methacryl POSS Cage Mixture, or any combination thereof. In the case of molecular silica POSS are DodecaPhenyl POSS, Isooctyl POSS Cage Mixture, Phenyllsobutyl POSS, Phenyllsooctyl POSS, Octalsobutyl POSS, OctaMethyl POSS, OctaPhenyl POSS, OctaTMA POSS, OctaTrimethylsiloxy POSS, or any combination thereof. In the case of Norbornenyls are NB1010-1,3-Bis(Norbornenylethyl)-1,1,3,3-tetramethyldisiloxane, Norbornenylethyldimethylchlorosilane, NorbornenylethylDiSilanollsobutyl POSS, Trisnorbornenyllsobutyl POSS, or any combination thereof. In the case of Olefins are Allysobutyl POSS, Vinyllsobutyl POSS, Vinyl POSS Cage Mixture, or any combination thereof. In the case of PEGs are PEG POSS Cage Mixture, MethoxyPEGIsobutyl POSS, or any combination thereof. In the case of silane is OctaSilane POSS, or any combination thereof. In the case of silanols are DiSilanollsobutyl POSS, TriSilanolEthyl POSS, TriSilanollsobutyl POSS, TriSilanollsooctyl POSS, TriSilanolPhenyl POSS Lithium Salt, TrisilanolPhenyl POSS, TetraSilanolPhenyl POSS, or any combination thereof. In the case of thiols is Mercaptopropyllsobutyl POSS, or any combination thereof.

Figure 3:
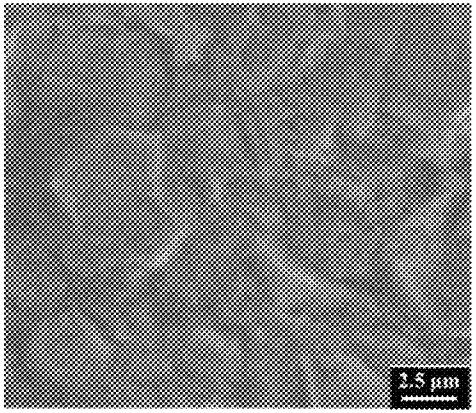
FIGS. 3(*a*) and 3(*b*) are an electron micrograph of one hydrophobic composite coating (3*a*) and an EDS map analysis of one hydrophobic composite coating (3*b*).
Figure 3:
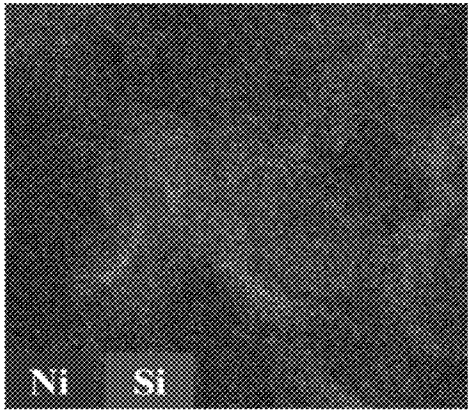
Figure 4:
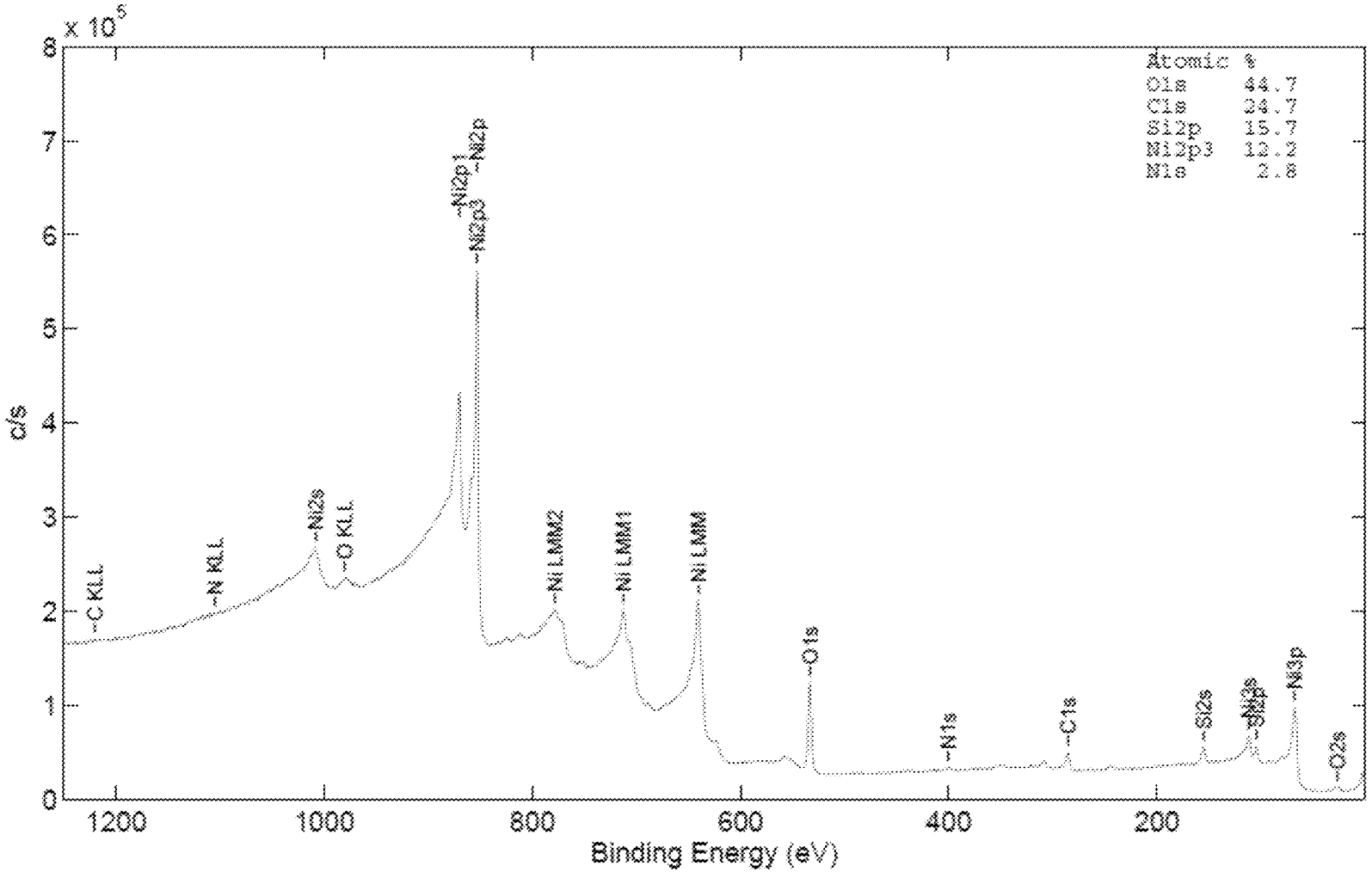
FIG. 4 shows the x-ray photoelectron spectroscopy results of the hydrophobic layer after one minute Argon sputtering.

FIG. 3*a* shows an electron micrograph of the hydrophobic layer in one of the coatings that was produced as described herein. The hydrophobic layer comprises nickel and silica particles wherein the particles that were modified with polydimethylsiloxane (PDMS). The EDS map analysis in FIG. 3*b* showed the presence of both nickel and silica particles in the structure of the hydrophobic layer and confirmed that the surface modified inorganic particles were embedded in the metal matrix. FIG. 4 shows the results of X-ray photoelectron spectroscopy of the hydrophobic layer after 1 minute Argon sputtering. From the atomic percentage of Si element in FIG. 4, it can be concluded that the surface content of the inorganic particles is around 15 percent. Higher surface content of the modified inorganic particles will result in higher contact angle of the hydrophobic layer.

In certain example, at least 20 to 50 percent of the coating layer may provide hydrophobic characteristics without any additional surface treatment. For example, water contact angle (WCA) can be more than 900 on the hydrophobic region of the coating layer. Water contact angle was measured at different locations of the coating layer using a contact angle measurement equipment by placing a 5 microliters to 10 microliters droplet at different locations. WCA is conventionally measured through the droplet, where the water-air interface meets the solid surface.

In performing WCA measurements, a Theta Lite contact angle measurement system provided by BioLin Scientific Company head quartered in Finland was used. For the coating layer shown in FIGS. 3*a-b*, the water contact angle (WCA) on at least 20 to 50 percent of the layer was more than 900 (measured to be around 100°). This contact angle is higher than the WCA of a pure nickel or a pure silica surface. This high contact angle confirms the presence of low-surface energy materials (in this case PDMS) that were used for surface modification of silica particles.

In certain examples, a process for producing a hydrophobic layer comprising a metal-based matrix and low surface energy particles is now described. In some configurations, the process comprises at least one electrochemical deposition technique comprising the following steps: forming a mixture comprising a single positively-charged metallic ion or positively-charged metallic complex and at least one dispersion solution of low-surface energy inorganic particles; positioning a substrate in the mixture; electrochemically depositing a hydrophobic layer comprising a metal-based matrix and at least one type of surface-modified inorganic particles. This electrochemical deposition technique should result in the formation of a coating layer that provides hydrophobicity as explained herein.

The electrochemical deposition technique can be selected from a group consisting of electrodeposition process, electroplating, electroless deposition process, auto-catalytic plating, plating, or any combination thereof. Without wishing to be bound by any particular theory, electroless plating is a non-galvanic plating method that involves several simultaneous reactions in an aqueous solution, which occur without the use of external electrical power. This process is also known as chemical or auto-catalytic plating. It is mainly different from electroplating by not using external electrical power. The process relies on the presence of a reducing agent, which reacts with the metal ions to deposit metal on a substrate. The positive charge metal ions are neutralized by a reducing agent and co-deposited on the substrate in the presence of the low surface energy particles in the solution. Electroless plating has two main components that are explained as follows:

Electrolyte. Electrolyte is an aqueous mixture of different components. One of these components should be a positively-charged agent that is reduced by reducing agent and gets co-deposited with the low surface energy particles on the substrate. At least one of these components should be a reducing agent which can catalytically reduce the metal ions in the electrolyte solution. The reducing agent may comprise one or more of sodium hypophosphate, sodium borohydride, dimethylamineborane, hydrazine, formaldehyde, or any combination thereof. In addition to the mentioned components, electrolyte can consist of other compounds including but not limited to ionic compounds such as negatively-charged agents to enhance electrolyte conductivity, buffer compounds to stabilize electrolyte pH, and different additives as mentioned earlier in the electrodeposition section.

Substrate. The substrate can be a part of the base article for the coating. It can have different shapes. As an instance, the substrate can be a tube or an object with any regular or irregular geometry. The substrate can be made of any materials that can get plated using electroless deposition including but not limited to metals, metal alloys, composites, ceramics, polymers, wood, glass, or any combination thereof.

Figure 5:
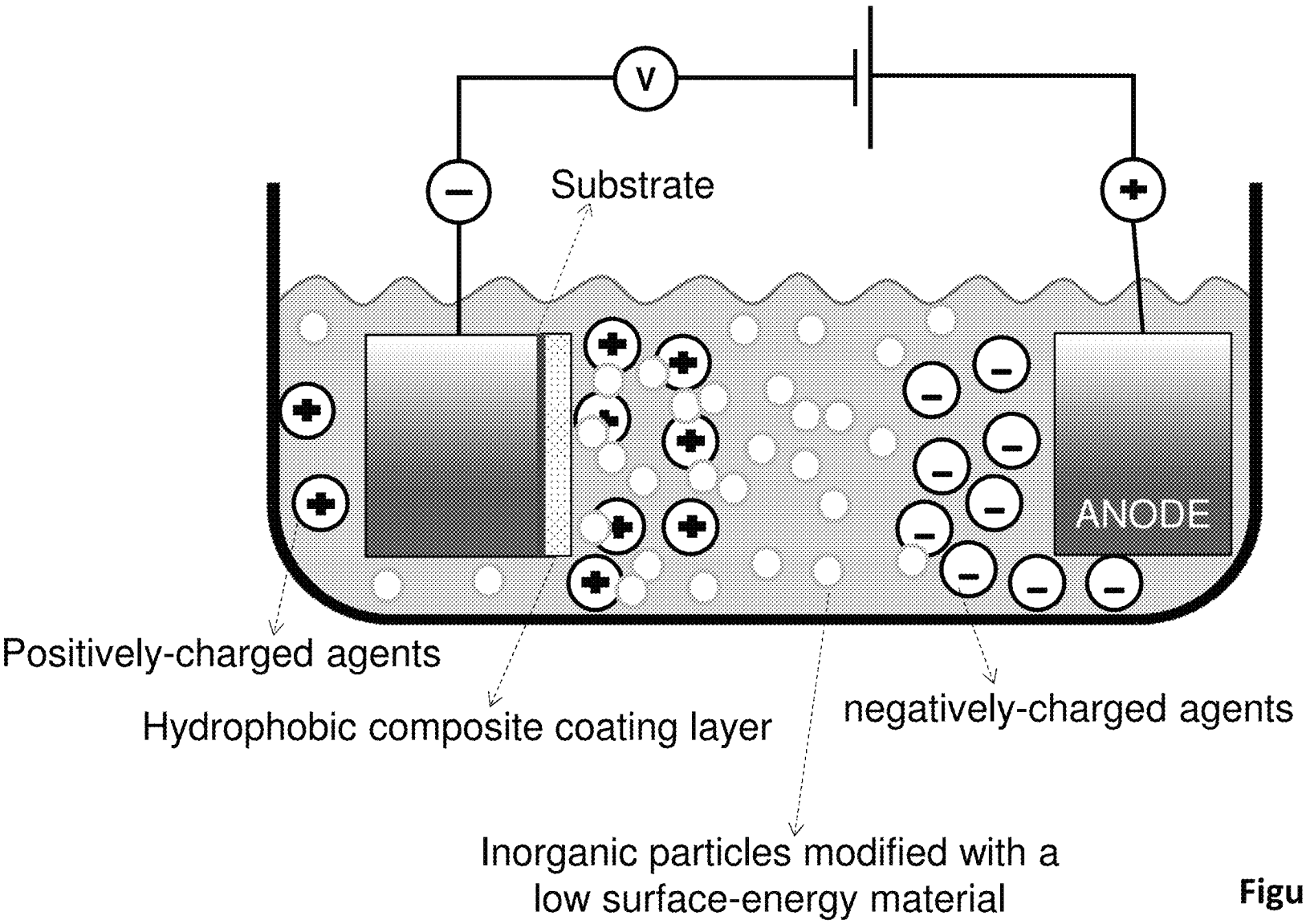
FIG. 5 is an illustration of an electrodeposition apparatus.

Electrodeposition will be explained further as a non-prophetic example of a manufacturing process. FIG. 5 is an illustration of an electrodeposition apparatus that can be used in the process. As this figure shows the setup consists of three main components: electrolyte, negative electrode or cathode, and positive electrode or anode. Cathode is the substrate that the coating layer will be applied on. Both cathode and anode should first be placed in the electrolyte mixture. When electricity is applied, substrate becomes negatively-charged and attracts positive ions in the solution. Positive ions are neutralized on the substrate and make the metal-based matrix. At the same time, low surface energy particles get entrapped in the metal-based matrix and co-deposited on the substrate. The co-deposition of metal-based matrix and low surface energy particles on the substrate make the hydrophobic coating layer. A constant, multistep, or varying voltage can be applied in the electroplating process. Constant or varying voltage in the range of −0.1 to −100 V or constant or varying current density in the range of −5 to −500 mA/cm$^2$ can be applied in the electrodeposition process. The three components of the electrodeposition technique are explained as follows:

Electrolyte. Electrolyte is an aqueous mixture of different components. One of these components is a positively-charged agent that is reduced by applying electricity and gets co-deposited with the low surface energy particles on the negative electrode. At least one of the components is low-surface-energy inorganic particles that is co-deposited with positive charge ions on the negative electrode. In addition to the mentioned components, electrolyte can consist of other compounds including but not limited to ionic compounds such as negatively-charged agents to enhance electrolyte conductivity, buffer compounds to stabilize electrolyte pH, and different additives and surfactants.

The particles can get dispersed in a separate solution and then get added to the electrolyte or they can get dispersed in the electrolyte directly. Dispersion of the particles in the aqueous electrolyte solution can be done using either of the following methods or a combination of both methods can be used:

First, an organic solvent or a mixture of several organic solvents can be used for dispersing the particles in the solution. Examples of organic solvents include but not limited to ethanol, methanol, propanol, isopropanol, dichloromethane, acetone, hexane, toluene, tetrahydrofuran, and any combination thereof.

Second, the particles can get dispersed in a solution by using at least one surfactant. Examples of surfactants include but not limited to cationic, anionic, zwitterionic, nonionic, polymeric cationic agents, and combination thereof.

The electrolyte comprises at least one cationic surfactant. This cationic surfactant may have two different functions. First, it will help in dispersing the inorganic particles. Second, the presence of the cationic surfactant in the electrolyte solution can ionize the low surface-energy inorganic particles and result in obtaining a higher content of the particles in the coating structure. The reason is that in the presence of a cationic surfactant, the particles gain positive charge and their electrophoretic mobility towards the negatively charged substrate (cathode) will increase. Examples of cationic surfactants include but not limited to alkylated and heavily alkylated quaternary ammonium salts, perfluorinated organo functional quaternary ammonium salts, Cetrimonium bromide or CTAB (cetyltrimethyl ammonium bromide), Cetylpyridinium chloride, Lauryl methyl gluceth-10 hydroxypropyl dimonium chloride, Domiphen bromide, Benzododecinium bromide, Octenidine dihydrochloride, fluoro-surfactant products, and combination thereof. As an instance, CAPSTONE® is a trademark of a fluoro-surfactant product that is a cationic surfactant provided by Dupont.

Negatively-charged agents include but not limited to bromide ($Br^-$), carbonate ($CO_3^-$), hydrogen carbonate ($HCO_3^-$), chlorate ($ClO_3^-$), chromate ($CrO_4^-$), cyanide (CN), dichromate ($Cr_2O_7^{2-}$), dihydrogenphosphate ($H_2PO_4^-$), fluoride ($F^-$), hydride ($H^-$), hydrogen phosphate ($HPO_4^{2-}$), hydrogen sulfate or bisulfate ($HSO_4^-$), hydroxide ($OH^-$), iodide ($I^-$), nitride ($N^{3-}$), nitrate ($NO_3^-$), nitrite ($NO_2^-$), oxide ($O_2^-$), permanganate ($MnO_4^-$), peroxide ($O_2^{2-}$), phosphate ($PO_4^{3-}$), sulfide ($S^{2-}$), thiocyanate ($SCN^-$), sulfite ($SO_3^{2-}$), sulfate ($SO_4^{2-}$), chloride ($Cl^-$), boride ($B^{3-}$), borate ($BO_3^{3-}$), disulfide ($S_2^{2-}$), phosphanide ($PH_2^-$), phosphanediide ($PH^{2-}$), superoxide ($O_2^-$), ozonide ($O_3^-$), triiodide ($I_3^-$), dichloride ($Cl_2^-$), dicarbide ($C_2^{2-}$), azide ($N_3^-$), pentastannide ($Sn_5^{2-}$), nonaplumbide ($Pb_9^{4-}$), azanide or dihydridonitrate ($NH_2^-$), germanide ($GeH_3^-$), sulfanide ($HS^-$), sulfanuide ($H_2S^-$), hypochlorite ($ClO^-$), hexafluoridophosphate ($[PF_6]^-$), tetrachloridocuprate(II) ($[CuCl_4]^{2-}$), tetracarbonylferrate ($[Fe(CO)_4]^{2-}$), tetrafluoroborate ($[BF_4^-]$), Bis(trifluoromethylsulfonyl)imide ($[NTf_2]^-$), trifluoromethanesulfonate ($[TfO]^-$), Dicyanamide $[N(CN)_2]^-$, methylsulfate $[MeSO_4]^-$, dimethylphosphate $[Me_2PO_4]^-$, acetate $[MeCO_2]$, other similar groups, or any combination thereof.

Different additives include but not limited to thiourea, acetone, ethanol, cadmium ion, chloride ion, stearic acid, ethylenediamine dihydrochloride, saccharin, cetyltrimethylammonium bromide (CTAB), sodium dodecyl sulfate, ethyl vanillin, ammonia, ethylene diamine, polyethylene glycol (PEG), bis(3-sulfopropyl)disulfide (SPS), Janus green B (JGB), azobenzene-based surfactant (AZTAB), the polyoxyethylene family of surface active agents, sodium citrate, perfluorinated alkylsulfate, additive K, calcium chloride, ammonium chloride, potassium chloride, boric acid, myristic acid, choline chloride, citric acid, any redox active surfactant, any conductive ionic liquids, any wetting agents, any leveling agent, any defoaming agent, any emulsifying agent or any combination thereof. Examples of wetting agents include but are not limited to polyglycol ethers, polyglycol alcohols, sulfonated oleic acid derivatives, sulfate form of primary alcohols, alkylsulfonates, alkylsulfates aralkylsulfonates, sulfates, Perfluoro-alkylsulfonates, acid alkyland aralkyl-phosphoric acid esters, alkylpolyglycol ether, alkylpolyglycol phosphoric acid esters or their salts, or any combination thereof. Examples of leveling agents include but not limited to N-containing and optionally substituted and/or quaternized polymers, such as polyethylene imine and its derivatives, polyglycine, poly(allylamine), polyaniline (sulfonated), polyvinylpyrrolidone, polyvinylpyridine, polyvinylimidazole, polyurea, polyacrylamide, poly(melamine-co-formaldehyde), polyalkanolamines, polyaminoamide and derivatives thereof, polyalkanolamine and derivatives thereof, polyethylene imine and derivatives thereof, quaternized polyethylene imine, poly(allylamine), polyaniline, polyurea, polyacrylamide, poly(melamine-co-formaldehyde), reaction products of amines with epichlorohydrin, reaction products of an amine, epichlorohydrin, and polyalkylene oxide, reaction products of an amine with a polyepoxide, polyvinylpyridine, polyvinylimidazole, polyvinylpyrrolidone, or copolymers thereof, nigrosines, pentamethyl-para-rosaniline, or any combination thereof are also present with an amount of 1 to 40 g/L in the electrolyte solution. Examples of defoaming agents include but not limited to fats, oils, long chained alcohols, or glycols, alkylphosphates, metal soaps, special silicone defoamers, commercial perfluoroalkyl-modified hydrocarbon defoamers and perfluoroalkyl-substituted silicones, fully fluorinated alkylphosphonates, perfluoroalkyl-substituted phosphoric acid esters, or any combination thereof. Examples of emulsifying agents include but not limited to cationic-based agents such as the alkyl tertiary heterocyclic amines and alkyl imadazolinium salts, amphoteric-based agents such as the alkyl imidazoline carboxylates, and nonionic-based agents such as the aliphatic alcohol ethylene oxide condensates, sorbitan alkyl ester ethylene oxide condensates, and alkyl phenol ethylene oxide condensates.

As a non-prophetic example, 1 to 100 (v/v %) organic solvents can be used in the electrolyte to disperse 0.1 gr/L to 100 gr/L low-surface energy inorganic particles. Moreover, 0.01 gr/L to 10 gr/L cationic surfactant can be added to the electrolyte, as well. Other components of the electrolyte may comprise: Nickel Sulfate ($NiSO_4$), Nickel chloride ($NiCl_2$), or their combination. These compounds are the source of positively-charged nickel ions in the electrolyte. The concentration of nickel ion in the electrolyte may be between 50 g/L to 1000 g/L. The electrolyte may also include a pH adjusting agent selected from a group including but not limited to weak acids such as boric acid, ammonium bases, phosphonium bases, or any combination thereof in an amount between 5 g/L to 500 g/L. The pH of the electrolyte can be in the range of 1 to 10. The electrodeposition can be performed under non-agitating or agitating condition with the agitation rate from 0 to 800 rpm.

Cathode. Cathode is a part of the base article of the coating or substrate that is exposed to the electrolyte. In FIG. 5, substrate is schematically depicted as a flat plate; however, it can have different shapes. As an instance, the substrate can be a tube or an object with any regular or irregular geometry. The substrate can be made of any materials that can get electroplated using electrodeposition or electroless deposition including but not limited to metals, metal alloys, composites, ceramics, polymers, wood, glass, or any combination thereof.

Anode. In a two-electrode electrodeposition process such as that depicted in FIG. 5, anode is the reference of the voltage. It is also possible to provide a third electrode as a voltage reference. In FIG. 5, anode is schematically depicted as a flat plate; however, it can have different shapes. As an instance, it can be in the shape of pallets, mesh, bar, cylinder, or it can be a part of an object with any regular or irregular geometry. Anode can gradually dissolve during the electrodeposition process and contribute in replenishing the positively charged-ions in the electrolyte. As a non-limiting example, nickel plates can be used in the nickel electrodeposition process. Unlike soluble anodes, some anodes such as those made of platinum or titanium remain intact during the electrodeposition process.

In certain embodiments, the coatings described herein may provide certain properties and/or conditions. The attributes explained herein are not required for the disclosed coating but are merely illustrative of some of the various properties, conditions and/or attributes which the coatings may provide.

In one configuration, the hydrophobic coating layer can be treated with a layer comprising hybrid organic-inorganic materials which can be crosslinked in the presence of heat or photo initiators. This surface treatment includes three major components comprising inorganic-organic hybrid materials, at least one volatile organic solvent, and heat or photo initiators. The volatile organic solvent can be used to suspend or solubilize the hybrid inorganic-organic materials described herein. The volatile solvent can be volatilized at room temperature. Thus, when the hybrid inorganic organic materials are applied to the surface, the solvent evaporates, which causes the hybrid inorganic-organic materials to concentrate at an interface which is finally results in forming a crosslink network on the coating layer. Examples of volatile organic compounds (VOCs) include but not limited to volatile alcohols, e.g., methanol, ethanol, etc.; acetone; volatile linear and branched alkanes, alkenes, and alkynes, e.g., hexane, heptane, and octane; and any combinations thereof. The components of the surface treatment formulation are cured and formed the cross-linked network. The crosslink formation is a result of crosslink polymerization of the components which is initiated by heat, ultraviolet (UV), or photo initiators. 2,2' azobis(2-methylpropionitrile) (AIBN) is an examples of heat initiators. Examples of photo initiators include bot not limited to 2-hydroxy-2-methylpropiophenone (DARUCUR1173) and 2,2-Dimethoxy-2-phenylacetophenone (DMPA).

As a non-prophetic example, in the case of thermal crosslink polymerization, the surface is cured at 250° C. after 1 h followed by an annealing step at 400° C. for an additional 1 h. In the case of UV crosslink polymerization, the surface is placed in a UV chamber under exposure of UV light at 254 nm for 2 h followed by an annealing step for an additional 1 h.

The inorganic-organic hybrid materials can get selected from a group comprising but not limited to surface modified inorganic particles, organofunctional silane, parylene, fluorinated alkylsilane, fluorinated alkylsiloxane, fluorinated based organo-functional silane, fluorinated based organofunctional siloxane, organofunctional resins, hybrid inorganic organofunctional resins, silicone polymers, polydimethylsiloxane, organofunctional silicone polymers, organofunctional silicone copolymers, fluorinated organofunctional silicone copolymers, organo-functional oligomeric siloxane, fluorinated organo-functional oligomeric siloxane, organofunctional polyhedral oligomeric silsesquioxane (POSS), fluorinated polyhedral oligomeric silsesquioxane (FPOSS), fluorinated oligomeric polysiloxane, organofunctional oligomeric poly siloxane, fluorinated organofunctional silicone copolymers, organofunctional silicone polymers, hybrid inorganic organofunctional silicone polymers, organofunctional silicone copolymers, hybrid inorganic organofunctional silicone copolymers, non-volatile linear and branched alkanes, alkenes and alkynes; esters of linear and branched alkanes, alkenes and alkynes, perfluorinated organic material, silane coupling agents, organofunctional silane systems, polymer blend, or any combinations thereof. The polymer blend can get selected from a group including but not limited to organic polymers, thermoplastic polymers, thermosetting polymers, copolymers, terpolymers, block copolymers, alternating block copolymers, random polymers, homopolymers, random copolymers, random block copolymers, graft copolymers, star block copolymers, dendrimers, poly electrolytes, poly ampholytes (polyelectrolytes having both cationic and anionic repeat groups), ionomers, polyampholytes (contain both anionic and cationic species that may be neutralized), ionomer (polymers that comprise repeat units of both electrically neutral repeating units and a fraction of ionized units), oligomers, cross-linkers, or any combination thereof. Examples of organic polymers include but not limited to polyacetals, polyolefins, polyacrylics, polycarbonates, polystyrenes, polyesters, polyamides, polyamidimides, polyacrylates, polyarylsulfones, polythersulfones, polyphenylene sulfides, polyvinylchlorides, polysulfones, polyimides, polyetherimides, polytetrafluoroethylenes, polyether ketone ketones, polybenzoxazoles, polyphthalides, polyacetals, polyanhydrides, polyvinyl ethers, polyvinyl thioethers, polyvinyl alcohols, polyvinyl ketones, poly vinyl halides, polyvinyl nitriles, polyvinyl esters, polysulfonates, poly sulfides, polythioesters, polysulfones, polysulfonamides, polyureas, polyphosphazenes, polysilazanes, styrene acrylonitrile, acrylonitrile-butadiene-styrene (ABS), polyethylene terephthalate, polybutylene terephthalate, polyurethane, ethylene ptopylene diene rubber (EPR), perfluoroelastomers, fluorinated ethylene propylene, perfluoroalkoxyethylene, poly-chlorotrifluoroethylene, polyvinylidene fluoride, polysiloxanes, or any combination thereof. Examples of polyelectrolytes include but not limited to polystyrene sulfonic acid, polyacrylic acid, pectin, carrageenan, alginates, carboxymethylcellulose, polyvinylpyrrolidone, or any combination thereof. Examples of thermosetting polymers include but not limited to epoxy polymers, unsaturated polyester polymers, polyimide polymers, bismaleimide polymers, bismaleimide triazine polymers, cyanate ester polymers, vinyl polymers, benzoxazine polymers, benzocyclobutene polymers, acrylics, alkyds, phenol-formaldehyde polymers, urea-formaldehyde polymers, novolacs, resoles, melamine-formaldehyde polymers, urea-formaldehyde polymers, hydroxymethylfuranes, isocyanates, diallyl phthalate, triallyl cyanurate, triallyl isocyanurate, unsaturated polysterimides, or any combination thereof. Examples of thermoplastic polymers include but not limited to acrylonitrile-butadiene-styrene/nylon, polycarbonate/acrylonitrile-butadiene-styrene, acrylonitrile butadiene styrene/polyvinyl chloride, polyphenylene ether/polystyrene, polyphenylene ether/nylon, poly sulfone/acrylonitrile-butadiene-styrene, polycarbonate/thermoplastic urethane, polycarbonate/polybutylene terephthalate, thermoplastic elastomer alloys, nylon/elastomers, polyester/elastomers, polyethylene terephthalate/polybutylene terephthalate, acetal/elastomer, styrene maleicanhydride/acrylonitrile-butadiene-styrene, polyether etherketone/polyethersulfone, polyether, etherketone/polyetherimide polyethylene/nylon, polyethylene/polyacetal, or any combination thereof.

The compounds of the surface treatment can either get physically immobilized on the surface of the hydrophobic coating layer or chemically interact with the coating layer. The surface treatment formulation can be deposited on the hydrophobic layer by at least one of the methods, including sol-gel spray, dip, brush, flow, sonication, and any combination thereof. As an exemplary case, the formulation solution can be prepared and sprayed on the surface as the following composition: hybrid inorganic-organic materials in an amount of 0.1 to 50 (w/v %), thermal or UV-photo initiators in an amount of 0.1-10 (w/v %), and a volatile solvent. As noted herein, the cross-linkable surface treatment may have surface-modified inorganic particles. However, unlike the disclosed hydrophobic layer that has a metallic matrix, the cross linkable surface treatment has a polymeric matrix.

In another configuration, the coating can comprise additional top layers comprising one or more organic materials. Examples of organic materials used as the top layer include but not limited to organofunctional silane, parylene, fluorinated alkylsilane, fluorinated alkylsiloxane, fluorinated based organo-functional silane, fluorinated based organofunctional siloxane, organofunctional resins, hybrid inorganic organofunctional resins, silicone polymers, polydimethylsiloxane, organofunctional silicone polymers, organofunctional silicone copolymers, fluorinated organofunctional silicone copolymers, organo-functional oligomeric siloxane, fluorinated organo-functional oligomeric siloxane, organofunctional polyhedral oligomeric silsesquioxane (POSS), fluorinated polyhedral oligomeric silsesquioxane (FPOSS), fluorinated oligomeric polysiloxane, organofunctional oligomeric poly siloxane, fluorinated organofunctional silicone copolymers, organofunctional silicone polymers, hybrid inorganic organofunctional silicone polymers, organofunctional silicone copolymers, hybrid inorganic organofunctional silicone copolymers, non-volatile linear and branched alkanes, alkenes and alkynes; esters of linear and branched alkanes, alkenes and alkynes, perfluorinated organic material, silane coupling agents, organofunctional silane systems, polymer blends, or any combinations thereof.

As a non-limiting example, the hydrophobic coating layer was treated with trimethylsiloxy terminated-PDMS as an organofunctional silicon polymer. A solution of 1 to 15 (v/v %) PDMS in ethanol was prepared and applied as a spray coating solution. A spray gun with adjustable pressure was used for the spray coating. In this step, the pressure was adjusted at a range from 10-30 psi, the spray pattern was between 1-5 inch, and the gun distance was between 1-5 inch. The sprayed sample was then cured in an oven at 100-400° C. for 1-5 hr.

In some instances, the hydrophobic coating layer can be produced using a process that comprises a combination of an electrochemical deposition technique and any other technique including, but not limited to, annealing and thermal processing, vacuum conditioning, aging, plasma etching, grit blasting, wet etching, ion milling, exposure to electromagnetic radiation such as visible light, UV, and x-ray, other processes, and combinations thereof. In addition, the manufacturing process of the hydrophobic coating layer can be followed by at least one additional coating process selected from a group consisting of electrodeposition, electroless deposition, surface functionalization, electro-polymerization, spray coating, brush coating, dip coating, electrophoretic deposition, reaction with fluorine gas, plasma deposition, brush plating, chemical vapor deposition, sputtering, physical vapor deposition, passivation through the reaction of fluorine gas, any other coating technique, or any combination thereof.

Figure 6:
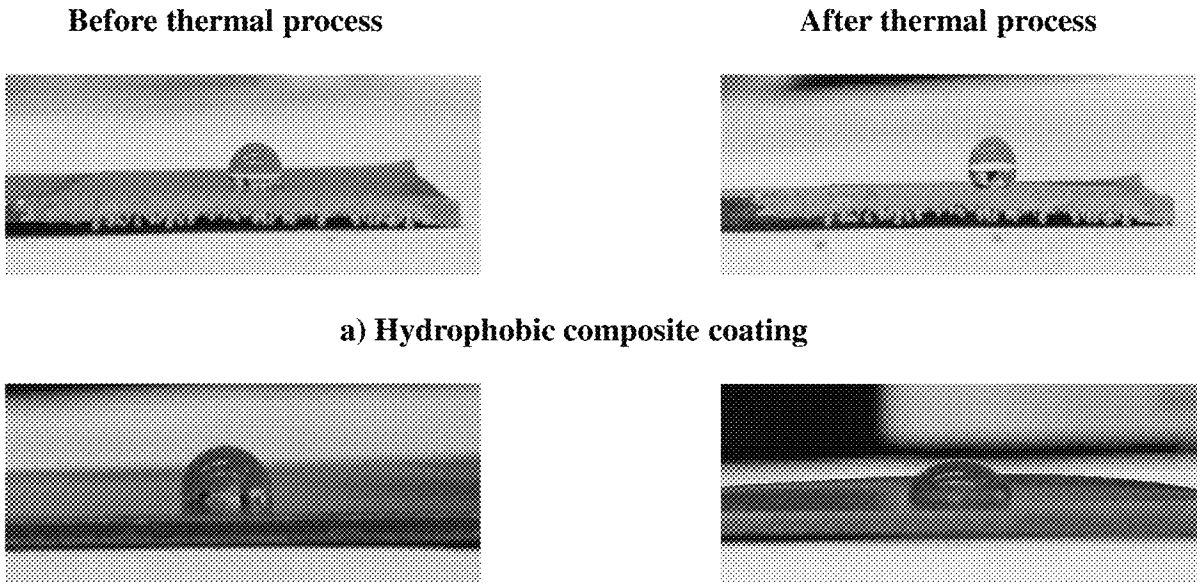
FIG. 6 shows a water contact angle on (a) a hydrophobic composite coating, and (b) electroless Ni-PTFE before and after the thermal process at 300° C. for 24 hours.

In some examples, the coatings described herein, can provide heat-resistant characteristics. This characteristic is observed if water contact angle of the coating changes less than 20 percent after a thermal process at 100° C. or higher for 12 hours or longer. As a non-prophetic example, the results of the heat-resistance test for one of the coatings is explained here. This test was performed at 572° F. (300° C.). This temperature is far beyond the temperature reported in the literature for Teflon® breakdown. In fact, toxic fumes generated from Teflon® breakdown at 396° F. are enough to kill birds (Boucher, Ehmler, & Bermudez, 2000). The thermal resistance of the hydrophobic composite coating can also be compared with electroless Ni-PTFE. Ni-PTFE is a hydrophobic composite coating that is commercially available. Both coating samples are placed in an oven at 300° C. for 24 hours and the mass loss and water contact angles are measured before and after the thermal process. In this test, the composite coating exhibited negligible weight loss while the weight loss of the industrial Ni-PTFE coating was around 0.3 mg. While the mass loss of the PTFE-contained coating can be inferred to the formation of toxic fumes, the results show that the composite coating exhibits negligible off-gas at high temperatures. Moreover, as shown in FIGS. 6*a* and 6*b*, the water contact angle of industrial Ni-PTFE was significantly decreased, while in the case of the composite coating, the contact angle of water was even improved after the thermal process.

Figure 7A:
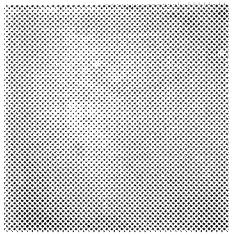
FIGS. 7*a* and 7*b* shows the results of a cleanability test of one hydrophobic composite coating (FIG. 7*a*), and electroless Ni-PTFE (FIG. 7*b*)
Figure 7B:
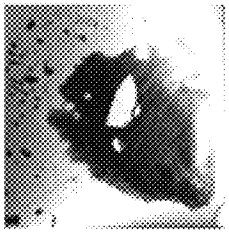
Figure 8:
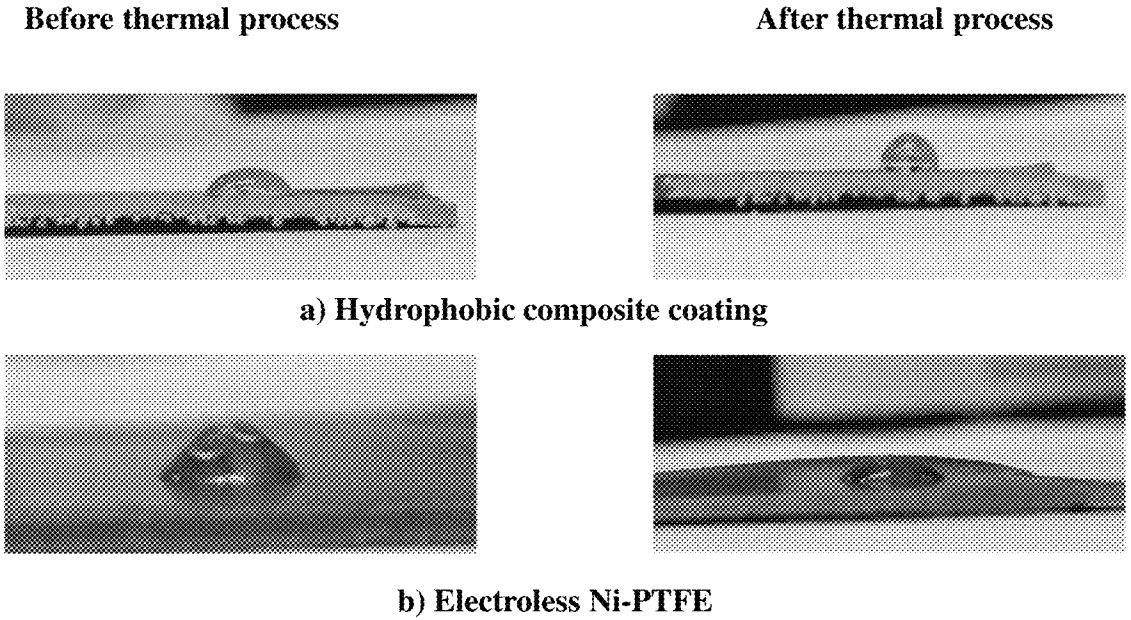
FIG. 8 shows the results of a cooking oil contact angle on (a) a hydrophobic composite coating, and (b) electroless Ni-PTFE before and after the thermal process at 300° C. for 24 hours.

In some examples, the coatings described herein may provide easy-clean characteristics. As used herein, easy-clean characteristic is defined, wherein in a cleanability test, at least 50 percent of the surface can be cleaned. In this test, the coating is painted with cooking oil and remained in an oven at 300° C. for 24 hours. It will then be wiped out with a wet tissue. As a non-limiting example shown in FIG. 7, the clean-ability performance of a hydrophobic composite coating was tested in comparison with industrial electroless Ni-PTFE. FIGS. 7*a* and 5*b* show that this cleaning process was significantly successful for a hydrophobic composite coating compared to the industrial PTFE-contained coating. Easy-clean characteristic is also related to the coating oleophobicity. The oleophobic characteristic can be measured by the contact angle of oil on a surface. As a non-limiting example shown in FIG. 8*a* the oil contact angle on the PTFE contained Ni coating reduces significantly after the thermal process. Interestingly, the oil contact angle on the coating increased after the thermal process (FIG. 8*b*).

Figure 9:
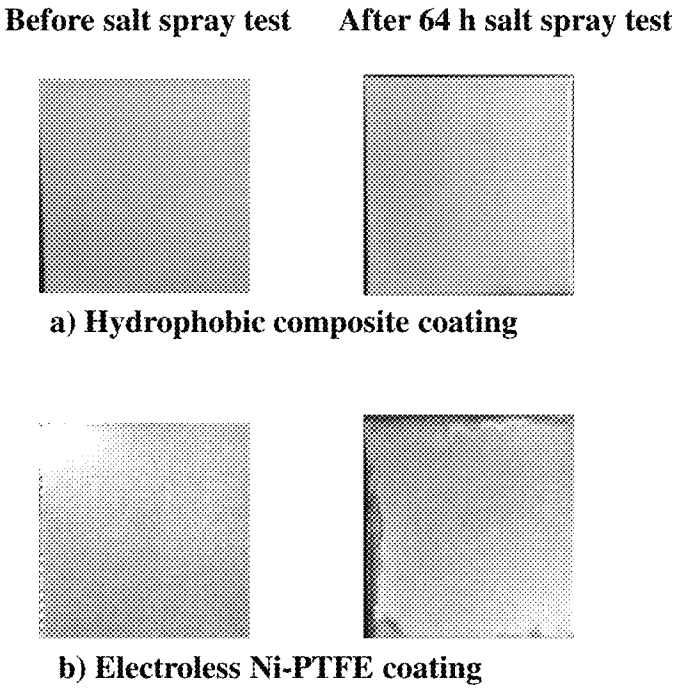
FIG. 9 shows the salt spray results of (a) a hydrophobic composite coating, and (b) electroless Ni-PTFE.

In certain examples, the coatings described herein may provide anti-corrosion properties. For example, due to the presence of low surface particles in the coating layer, it is expected to obtain better anti-corrosion properties for the hydrophobic composite coatings compared to existing industrial coatings. Standard salt spray test (ASTM B117) was performed on one of the hydrophobic composite coating in comparison with industrial electroless Ni-PTFE coating. FIGS. 9*a-b* show the results of the salt spray test after 8 cycles of salt spray for a total of 64 h and 32 h of air exposure between the cycles for the composite coating and electroless Ni-PTFE coatings, respectively. As it shown in FIG. 9*b*, corrosion of the substrate deposited with the existing nickel-PTFE (9*b*) coating is initiated earlier than the substrate deposited with the hydrophobic composite coating (9*a*).

What is claimed is:

1. A process for producing a hydrophobic coating on a substrate, wherein the process comprises at least one electrochemical deposition technique comprising:

forming an aqueous solution comprising at least one positively-charged metal-based agent and at least one type of surface-modified inorganic particles dispersed in the solution, wherein the surface-modified inorganic particles comprise a plurality of nanopores;

positioning the substrate in the solution; and electrochemically depositing a two-phase hydrophobic coating comprising a first phase and a second phase, wherein the first phase comprises a metal based matrix comprising a single metallic element or metallic compound formed from the at least one positively-charged metal-based agent, and wherein the second phase comprises the at least one type of surface-modified inorganic particles, and wherein the first phase is separated from the second phase.

2. The process of claim 1, wherein the hydrophobic coating is produced using a combination of an electrochemical deposition technique and at least one other technique selected from the group consisting of annealing, thermal processing, vacuum conditioning, aging, plasma etching, grit blasting, wet etching, ion milling, exposure to ultraviolet light, and combinations thereof.

3. The process of claim 1, wherein the electrochemical deposition technique is selected from the group consisting of an electrodeposition process, electroplating, electroless deposition process, auto-catalytic plating, and combinations thereof.

4. The process of claim 1, wherein the surface-modified inorganic particles are dispersed in the aqueous solution using at least one organic solvent selected from the group consisting of ethanol, methanol, propanol, isopropanol, dichloromethane, acetone, hexane, toluene, tetrahydrofuran, and combinations thereof.

5. The process of claim 1, wherein the surface-modified inorganic particles are dispersed in the aqueous solution using at least one surfactant selected from the group consisting of cationic, anionic, zwitterionic, nonionic, polymeric cationic agents, and combinations thereof.

6. The process of claim 1, wherein the surface-modified inorganic particles are dispersed in the aqueous solution using at least one organic solvent and at least one surfactant.

7. The process of claim 1, wherein the aqueous solution comprises at least one cationic surfactant selected from the group consisting of alkylated quaternary ammonium salts, perfluorinated organo functional quaternary ammonium salts, cetyltrimethyl ammonium bromide), Cetylpyridinium chloride, Lauryl methyl gluceth-10 hydroxypropyl dimonium chloride, Domiphen bromide, Benzododecinium bromide, Octenidine dihydrochloride, fluoro-surfactant products, and combinations thereof.

8. The process of claim 1, wherein the aqueous solution comprises at least one negatively-charged agent selected from the group consisting of bromide ($Br^-$), carbonate ($CO_3^-$), hydrogen carbonate ($HCO_3^-$), chlorate ($ClO_3^-$), chromate ($CrO_4^-$), cyanide ($CN^-$), dichromate ($Cr_2O_7^{2-}$), dihydrogenphosphate ($H_2PO_4^-$), fluoride ($F^-$), hydride ($H^-$), hydrogen phosphate ($HPO_4^{2-}$), hydrogen sulfate or bisulfate ($HSO_4^-$), hydroxide ($OH^-$), iodide ($I^-$), nitride ($N^{3-}$), nitrate ($NO_3^-$), nitrite ($NO_2^-$), oxide ($O_2^-$), permanganate ($MnO_4^-$), peroxide ($O_2^{2-}$), phosphate ($PO_4^{3-}$), sulfide ($S^{2-}$), thiocyanate ($SCN^-$), sulfite ($SO_3^{2-}$), sulfate ($SO_4^{2-}$), chloride ($Cl^-$), boride ($B^{3-}$), borate ($BO_3^{3-}$), disulfide ($S_2^{2-}$), phosphanide ($PH_2^-$), phosphanediide ($PH^{2-}$), superoxide ($O_2^-$), ozonide ($O_3^-$), triiodide ($I_3^-$), dichloride ($Cl_2^-$), dicarbide ($C_2^{2-}$), azide ($N_3^-$), pentastannide ($Sn_5^{2-}$), nonaplumbide ($Pb_9^{4-}$), azanide or dihydridonitrate ($NH_2^-$), germanide ($GeH_3^-$), sulfanide ($HS^-$), sulfanuide ($H_2S^-$), hypochlorite ($ClO^-$), hexafluoridophosphate ($[PF_6]^-$), tetrachloridocuprate(II) ($[CuCl_4]^{2-}$), tetracarbonylferrate ($[Fe(CO)_4]^{2-}$), tetrafluoroborate ($[BF_4^-]$), Bis(trifluoromethylsulfonyl)imide ($[NTf_2]^-$), trifluoromethanesulfonate ($[TfO]^-$), Dicyanamide $[N(CN)_2]^-$, methylsulfate $[MeSO_4]^-$, dimethylphosphate $[Me_2PO_4]^-$, acetate $[MeCO_2]^-$, and combinations thereof.

9. The process of claim 1, wherein the single metallic element or metallic compound comprises nickel.

10. The process of claim 1, wherein a water contact angle of the hydrophobic coating is more than 90 degrees.

11. The process of claim 1, wherein the at least one positively-charged metal-based agent comprises nickel.

12. The process of claim 11, wherein the nickel is present as nickel sulfate or nickel chloride or both.

* * * * *